US010875035B2

(12) United States Patent
Coplin

(10) Patent No.: US 10,875,035 B2
(45) Date of Patent: Dec. 29, 2020

(54) SPLIT BODY FLUIDIC SPRAY NOZZLE

(71) Applicant: Spraying Systems Co., Wheaton, IL (US)

(72) Inventor: Thomas L. Coplin, Carol Stream, IL (US)

(73) Assignee: Spraying Systems Co., Wheaton, IL (US)

( * ) Notice: Subject to any disclaimer, the term of this patent is extended or adjusted under 35 U.S.C. 154(b) by 15 days.

(21) Appl. No.: 16/280,172

(22) Filed: Feb. 20, 2019

(65) Prior Publication Data

US 2019/0255541 A1 Aug. 22, 2019

Related U.S. Application Data

(60) Provisional application No. 62/632,673, filed on Feb. 20, 2018.

(51) Int. Cl.
*B05B 1/08* (2006.01)
*B05B 12/06* (2006.01)
*F15C 1/22* (2006.01)

(52) U.S. Cl.
CPC ..... *B05B 1/08* (2013.01); *B05B 12/06* (2013.01); *F15C 1/22* (2013.01)

(58) Field of Classification Search
CPC ... B05B 1/08; B05B 12/06; F15C 1/22; F15B 21/12; B60S 1/52
USPC ..... 239/589.1
See application file for complete search history.

(56) References Cited

U.S. PATENT DOCUMENTS 4,463,904 A * 8/1984 Bray, Jr. ..... B05B 1/08 239/589.1
5,845,845 A * 12/1998 Merke ..... B05B 1/08 239/1
6,240,945 B1 * 6/2001 Srinath ..... B05B 1/08 137/14
7,316,362 B2 * 1/2008 Miyauchi ..... B05B 1/08 239/102.1
8,061,630 B2 * 11/2011 Utz ..... B05B 1/08 239/284.1
8,430,108 B2 * 4/2013 Bettenhausen ..... B60S 1/52 134/123
2006/0108442 A1 * 5/2006 Russell ..... B05B 1/14 239/102.1

(Continued)

FOREIGN PATENT DOCUMENTS

WO WO-2017085129 A1 * 5/2017 ..... F02M 61/1806

*Primary Examiner* — Darren W Gorman
(74) *Attorney, Agent, or Firm* — Leydig, Voit & Mayer, Ltd.

(57) ABSTRACT

A spray nozzle assembly for producing an oscillating spray discharge is provided. The spray nozzle assembly includes a nozzle body with a liquid inlet passage that converges via an inwardly converging conical section that defines a liquid inlet orifice. An expansion chamber communicates in a downstream direction with the liquid inlet orifice. An exit orifice communicates in the downstream direction with the expansion chamber. A pair of longitudinal veins and a pair of outwardly disposed feedback passages are provided in the expansion chamber. Each vein defines a respective downstream orifice to a respective one of the feedback passages adjacent the exit orifice and an upstream orifice to the respective one of the feedback passages adjacent the inlet orifice.

15 Claims, 3 Drawing Sheets

(56) References Cited

U.S. PATENT DOCUMENTS

| | | | | |
|---|---|---|---|---|
| 2006/0243823 | A1* | 11/2006 | Bachmann | B60S 1/52 239/284.1 |
| 2014/0097272 | A1* | 4/2014 | Nishio | B05B 15/654 239/284.1 |
| 2015/0197218 | A1* | 7/2015 | Umezawa | B05B 15/652 239/284.1 |
| 2017/0326560 | A1* | 11/2017 | Kanda | B05B 1/10 |
| 2018/0318848 | A1* | 11/2018 | Bobusch | F15B 21/12 |
| 2019/0135239 | A1* | 5/2019 | Rice | B60S 1/52 |

* cited by examiner

SPLIT BODY FLUIDIC SPRAY NOZZLE

This patent application claims the benefit of U.S. Provisional Patent Application No. 62/632,673, filed Feb. 20, 2018, which is incorporated by reference.

FIELD OF THE INVENTION

The present invention relates to liquid spray nozzle assemblies, and more particularly, to spray nozzle assemblies that require frequent or periodic cleaning for sanitary or other purposes.

BACKGROUND OF THE INVENTION

In the food industry, by way of example, hot liquids at temperatures of 140° Fahrenheit and more are sprayed at high pressures, such as 350 PSI or more, onto food products for various purposes. Liquid spray nozzles for such purpose often are designed to direct in oscillating high pressure liquid discharge for greater impact. Such nozzles commonly have a complex internal geometry needed to establish and maintain a predictable oscillation cycle that includes orifices and passages having a multiplicity of surfaces that cannot be easily or effectively cleaned. Flushing with chemicals may achieve acceptable levels of sanitation, but may not remove buildup of debris that may render the oscillating fluid discharge less effective.

OBJECTS AND SUMMARY OF THE INVENTION

It is an object of the invention to provide a liquid spray nozzle assembly that is adapted for easier and more effective cleaning.

Another object is to provide a liquid spray nozzle assembly as characterized above that has a relatively complex internal geometry, such as necessary, for example, in generating a high pressure oscillating liquid discharge.

A further object is to provide a liquid spray nozzle assembly of the above kind that is nevertheless relatively simple in design and economical to manufacture.

Other objects and advantages of the invention will become apparent upon reading the following detailed description and upon reference to the drawings.

Figure 2:
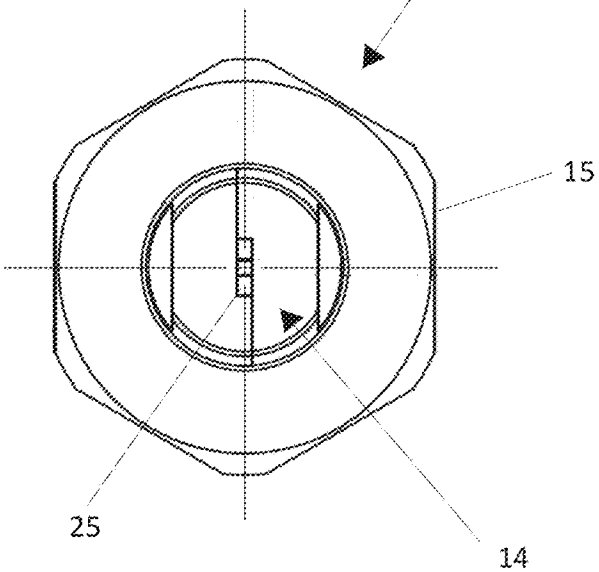
FIG. 2 is a downstream end view of the spray nozzle assembly shown in FIG. 1.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative spray nozzle assembly 10 in accordance with the invention. The illustrated spray nozzle assembly 10 basically comprises a liquid inlet body 11 having a liquid passage 12 connectable to a liquid supply, a nozzle body 14 mounted at a downstream end of the liquid inlet body 11, and an annular retaining cap 15 for securing the nozzle body 14 to the liquid inlet body 11.

The illustrated spray nozzle assembly 10, by way of example, is a fluidic spray nozzle assembly for discharging a high pressure oscillating spray discharge. For this purpose, the nozzle body 14 has an intricate internal liquid passageway system for acting on liquid directed through the nozzle body 14. The illustrated nozzle body 14 has a liquid inlet passage 18 that communicates with the inlet body passage 12 and which converges by way of an inwardly converging conical section 19 that defines a liquid inlet orifice 20. The liquid inlet orifice 20 communicates with a downstream expansion chamber 21, which in turn communicates with an axially aligned exit orifice 22. The exit orifice 22 in this instance is slightly smaller in diameter than the inlet orifice 20 and communicates through an outwardly flared section 24 with a nozzle body discharge orifice 25, which in this case has an elongated narrow rectangular configuration, as viewed in FIG. 2.

Figure 4:
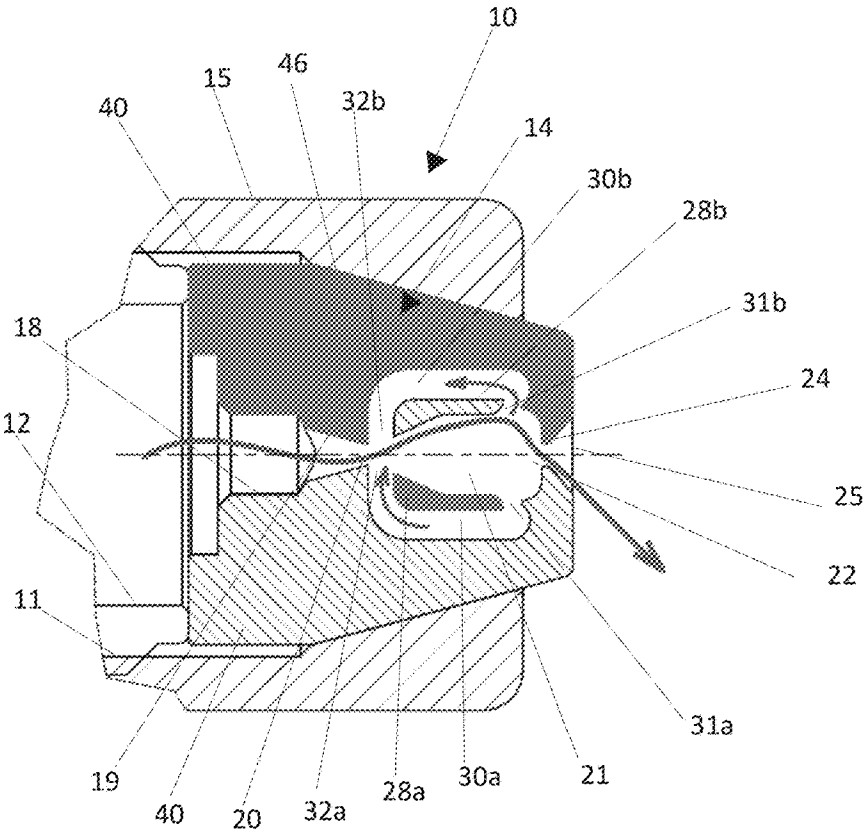
FIG. 4 is an enlarged fragmentary section, similar to FIG. 3, but showing the oscillating spray directed in an opposite direction.
Figure 3:
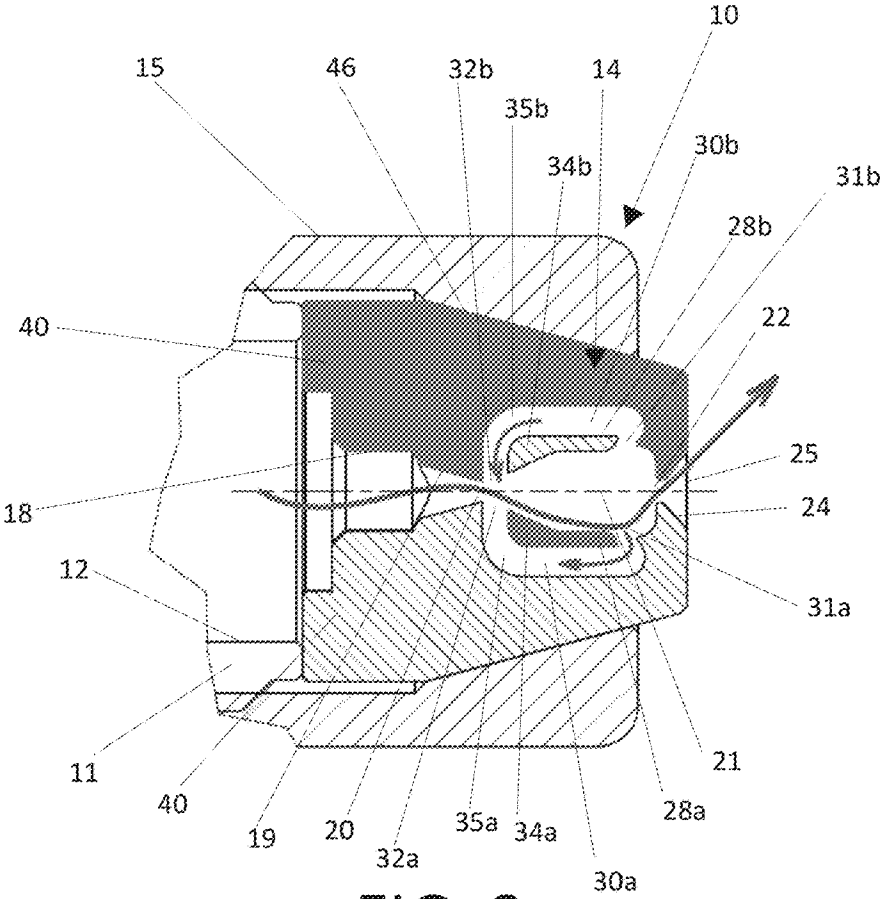
FIG. 3 is an enlarged fragmentary section of the illustrated spray nozzle assembly showing an oscillated spray discharge directed in one direction.

In order to produce a fluidic oscillating liquid discharge, the nozzle body 14 has a pair of longitudinal veins or ribs 28*a*, 28*b* which define the central expansion chamber 21 and a pair of outwardly disposed feedback passages 30*a*, 30*b*. The veins 28*a*, 28*b* define respective downstream orifices 31*a*, 31*b* adjacent the exit orifice 22 and upstream orifices 32*a*, 32*b* adjacent the inlet orifice 20. The veins 28*a*, 28*b* in this case each have an enlarged upstream end portion 34*a*, 34*b* that defines a curved right angle passage section 35*a*, 35*b* of each feedback passage 30*a*, 30*b* in communication with the inlet orifice 20. When liquid is directed through the nozzle body inlet orifice 20, and is guided downwardly against the lower vein 28*a*, as viewed in FIG. 3, it is redirected upwardly through the exit and discharge orifices 22, 25, creating a high pressure at the downstream feedback orifice 31*a*. That high pressure condition is communicated through the feedback passage 30*a* to the upstream orifice 32*a*, forcing liquid discharging from the inlet orifice 20 upwardly against the upper vein 28*b*, as viewed in FIG. 4, and in turn, downwardly through the exit discharge orifices 22, 25. This redirection of liquid creates a high pressure in the downstream feedback orifice 31*b*, which communicates with the upstream orifice 32*b* again forcing liquid discharging form the inlet orifice 20 in a downward direction against the lower vein 28*a*, as depicted in FIG. 3. The liquid flow stream through the nozzle body 14 is thereby influenced by the pressures at the orifices 31*a*, 32*a* and 31*b*, 32*b* for establishing a repeatable oscillation cycle, causing the exiting spray to oscillate up and down from the discharge orifices 22, 25.

Figure 5:
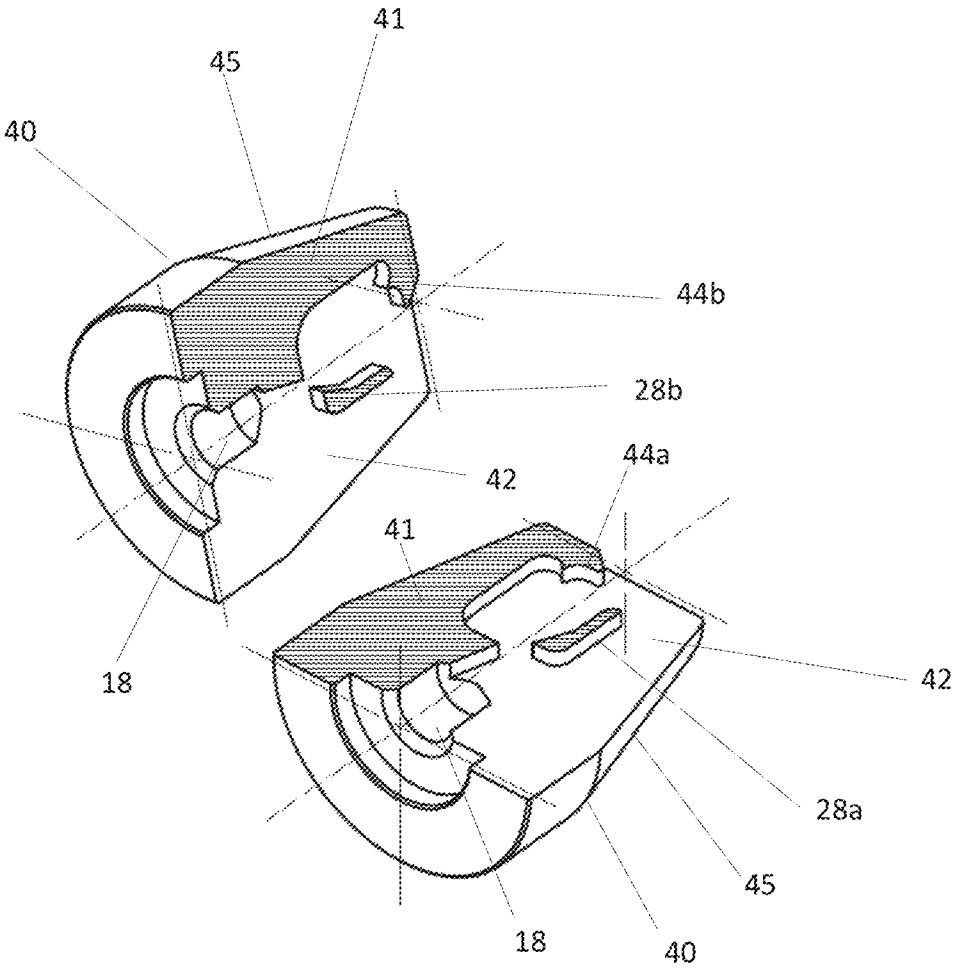
FIG. 5 is an exploded perspective of the multipart illustrated nozzle body in separated relation to each other.

In accordance with the invention, the nozzle body has a multipart separable construction that lends itself to economical manufacture and easy assembly, disassembly, and cleaning. The multiple nozzle body parts are separable along mating planes about a central axis of the nozzle body such that upon separation of the nozzle body parts, the internal geometry of the intricate passageway system of the nozzle body is fully exposed for easy and effective cleaning. In the illustrated embodiment, as depicted in FIG. 5, the nozzle body 14 comprises two identical nozzle parts 40 which have multiplane separating surfaces. The illustrated nozzle body parts 40 have two planar separating surfaces 41, 42. One of the planar surfaces 41 of each nozzle body part 40, being in raised elevation to the other or recessed planar surface 42 of the body part, defines a portion of the internal geometry of the nozzle body, and the other or recessed planar surface 42 of the body part 40 supports one of the elongated veins 28*a*, 28*b* outwardly therefrom to the level of the raised planar surface 41.

While the nozzle body parts 40 are identically formed, when assembled, the longitudinal vein 28*a*, 28*b* of each part mates with the recessed planar surface 42 of the other part so as to define the expansion chamber 21 therebetween and the feedback passages 30*a*, 30*b* outwardly thereof. The raised nozzle body surfaces 41 in this case each further define a respective downstream lip 44*a*, 44*b* extending radially inwardly, such that upon mating of the nozzle body parts 40 the discharge orifices 22, 25 are defined between the recess surfaces 42.

The nozzle body parts 40 preferably are machined of stainless steel, and as will be appreciated, since they are identical in form, they lend themselves to economical production. Because the parting planes of the nozzle parts 40 extend through the inlet passage 18, expansion chamber 21, feedback passages 30*a*, 30*b* and various orifices 20, 22, 25, 31*a*, 31*b*, 32*a*, and 32*b*, upon separation of the parts 40, the surfaces of those passage sections and orifices are easily accessible for efficient and thorough cleaning.

Figure 1:
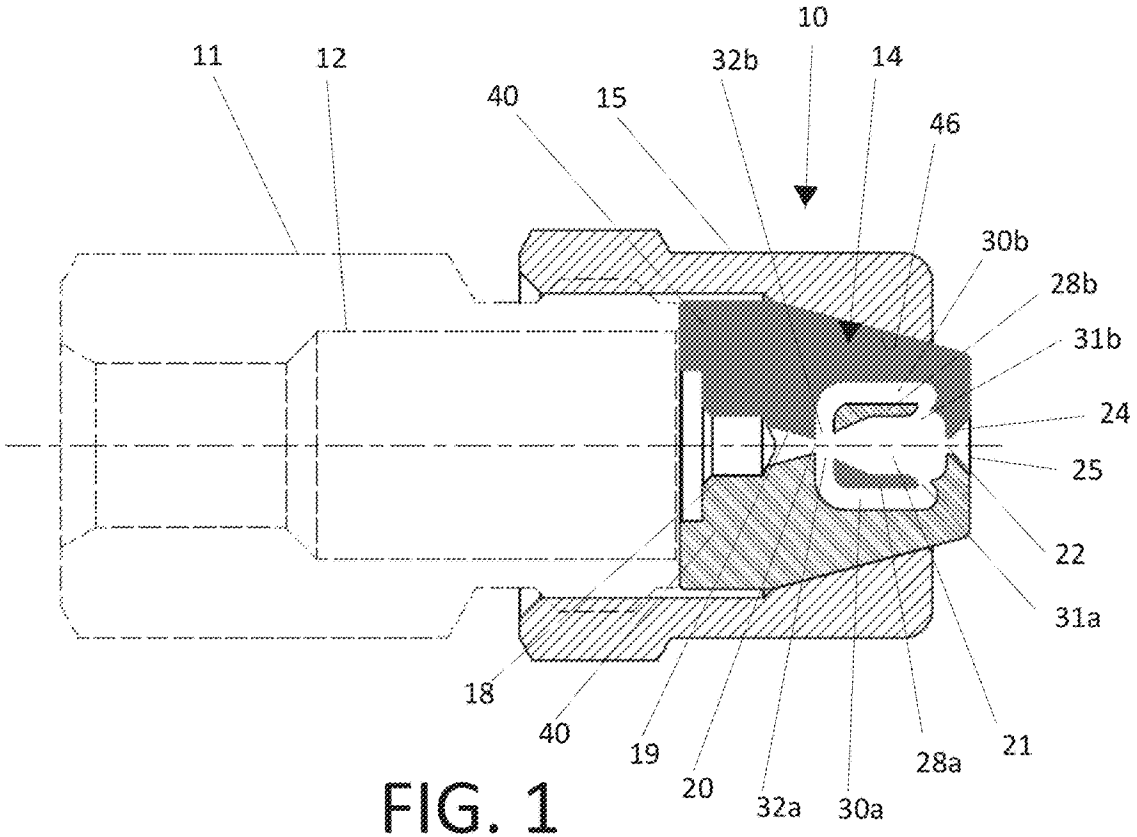
FIG. 1 is a longitudinal section of an illustrative spray nozzle assembly in accordance with the invention, with parts of the nozzle body highlighted differently for purposes of illustration.

In carrying out a further feature of the invention, parts of the nozzle assembly are easily assembled with the nozzle body parts 40 retained in close fitting liquid tight relation so as to prevent leakage even during high pressure spraying. To this end, the nozzle body parts 40 when in assembled relation to each other are secured to a downstream end of the inlet body 11 by the retaining cap 15 threadably secured to the nozzle body inlet 11. To that end, the nozzle body parts 40 have a frustoconical downstream end portion 45 (FIG. 4) that is as received within a complementary frustoconical retention recess 46 in the cap 15 (FIG. 1). With conical slope of the conical body portions 45 preferably between 7° and 30° to the horizontal, upon tightening of the retention cap 15 onto the inlet body 14 the mating conical surfaces force and clamp the nozzle body parts 40 into close fitting liquid tight relation to each other. To facilitate such securement the internal conical surface of the retention cap 15 preferably has a fine surface finish of 16 micro-inches or better. The retention cap 15 in this case has a wrench engageable external hex configuration.

From the foregoing, it can be seen that a spray nozzle assembly is provided that has a nozzle body constructed of a plurality of separable parts that allows for easy assembly, disassembly and cleaning. Each half of the spray nozzle incorporates half of the geometry necessary to form the orifices and critical passages required for the desired spray discharge. The geometry of the halves is designed such that when separated from the opposing half, obstructions to the passages are removed. Removal of the obstructions allows for better cleaning and sanitizing required for food processing and other sanitary spray applications where cleanness is critical. The spray nozzle assembly further includes a retaining cap for mounting the nozzle to the fluid source and in a manner that secures the opposing flat surfaces together in tight fitting relation and maintains the critical orifices and passages free of leakage even during high pressure spraying.

The invention claimed is:

1. A spray nozzle assembly for producing an oscillating spray discharge, the spray nozzle assembly comprising:

a nozzle body;

a liquid inlet passage in the nozzle body that converges via an inwardly converging conical section that defines a liquid inlet orifice;

an expansion chamber in the nozzle body that communicates in a downstream direction with the liquid inlet orifice;

an exit orifice in the nozzle body that communicates in the downstream direction with the expansion chamber;

a pair of longitudinal veins and a pair of outwardly disposed feedback passages in the expansion chamber, each vein defining a respective downstream orifice to a respective one of the feedback passages adjacent the exit orifice and a respective upstream orifice adjacent said liquid inlet orifice;

said nozzle body comprising first and second nozzle parts that are supported in opposed relation to each other and which each has a plurality of planar separating surfaces; said planar separating surfaces of said first and second nozzle parts each including a raised planar separating surface and a recessed planar separating surface with the raised planar separating surface being raised relative to the recessed planar separating surface; and said recessed planar separating surface of each of the first and second nozzle parts supporting a respective one of said longitudinal veins.

2. The spray nozzle assembly of claim 1 wherein the exit orifice has a smaller diameter than the inlet orifice.

3. The spray nozzle assembly of claim 2 wherein the exit orifice communicates through an outwardly flared section with a discharge orifice.

4. The spray nozzle assembly of claim 3 wherein the discharge orifice has a rectangular configuration.

5. The spray nozzle assembly of claim 1 wherein each vein has an enlarged upstream end portion that defines a curved right angle section of the respective feedback passage that communicates with the respective up stream orifice.

6. The spray nozzle assembly of claim 1 wherein the raised planar separating surface of each of the first and second nozzle parts defines a respective downstream lip that extends in a radially inward direction such that upon mating of the first and second nozzle parts the exit orifice is defined by the downstream lips and the recessed planar separating surfaces.

7. The spray nozzle assembly of claim 1 further including an inlet body and a retaining cap and wherein the first and second nozzle parts are held in assembled relation and secured to a downstream end of the inlet body by the retaining cap.

8. The spray nozzle assembly of claim 7 wherein the nozzle body has a frustoconical downstream end portion that is received within a complementary frustoconical recess in the retaining cap.

9. The spray nozzle assembly of claim 8 wherein the frustoconical downstream end portion has a conical slope of between approximately 7° and approximately 30° to a horizontal axis.

10. A spray nozzle assembly for producing an oscillating spray discharge, the spray nozzle assembly comprising:

an inlet body having a liquid passage connectable to a liquid supply;

a nozzle body secured at a downstream end of the inlet body by a retaining cap;

a liquid inlet passage in the nozzle body that communicates with the liquid passage in the inlet body and that converges via an inwardly converging conical section that defines a liquid inlet orifice;

an expansion chamber in the nozzle body that communicates in a downstream direction with the liquid inlet orifice;

an exit orifice in the nozzle body that communicates in the downstream direction with the expansion chamber;

a pair of longitudinal veins and a pair of outwardly disposed feedback passages in the expansion chamber, each vein defining a respective downstream orifice to a respective one of the feedback passages adjacent the exit orifice and an upstream orifice to the respective one of the feedback passages adjacent the inlet orifice;

said nozzle body comprising first and second nozzle parts each of which has a plurality of planar separating surfaces, said planar separating surfaces of said first and second nozzle parts each having a raised planar separating surface and a recessed planar separating surface with the raised planar separating surface being raised relative to the recessed planar separating surface; and said recessed planar separating surface of each of the first and second nozzle parts supporting a respective one of the longitudinal veins.

11. The spray nozzle assembly of claim 10 wherein the exit orifice communicates through an outwardly flared section with a discharge orifice.

12. The spray nozzle assembly of claim 10 wherein the nozzle body has a frustoconical downstream end portion that is received within a complementary frustoconical recess in the retaining cap.

13. The spray nozzle assembly of claim 12 wherein the frustoconical downstream end portion has a conical slope of between approximately 7° and approximately 30° to a horizontal axis.

14. A spray nozzle assembly for producing an oscillating spray discharge, the spray nozzle assembly comprising:

a nozzle body;

a liquid inlet passage in the nozzle body that converges via an inwardly converging conical section that defines a liquid inlet orifice;

an expansion chamber in the nozzle body that communicates in a downstream direction with the liquid inlet orifice;

an exit orifice in the nozzle body that communicates in the downstream direction with the expansion chamber;

a pair of longitudinal veins and a pair of outwardly disposed feedback passages in the expansion chamber, each vein defining a respective downstream orifice to a respective one of the feedback passages adjacent the exit orifice and a respective upstream orifice adjacent said liquid inlet orifice;

said nozzle body comprising first and second nozzle parts each of which has a plurality of planar separating surfaces;

a liquid inlet body and a retaining cap, said first and second nozzle parts being held in assembled relation and secured to a downstream end of the liquid inlet body by the retaining cap; and said nozzle body having a frustoconical downstream end portion that is received within a complementary frustoconical recess in the retaining cap; said frustoconical downstream end portion having a conical slope of between approximately 7° and approximately 30° to a horizontal axis; and said frustoconical recess in said retaining cap having a fine surface finish of approximately 16 micro-inches or less.

15. A spray nozzle assembly for producing an oscillating spray discharge, the spray nozzle assembly comprising:

a nozzle body;

a liquid inlet passage in the nozzle body that converges via an inwardly converging conical section that defines a liquid inlet orifice;

an expansion chamber in the nozzle body that communicates in a downstream direction with the liquid inlet orifice;

an exit orifice in the nozzle body that communicates in the downstream direction with the expansion chamber;

a pair of longitudinal veins and a pair of outwardly disposed feedback passages in the expansion chamber, each vein defining a respective downstream orifice to a respective one of the feedback passages adjacent the exit orifice and a respective upstream orifice adjacent said liquid inlet orifice;

said nozzle body comprising first and second nozzle parts that are separated in opposed relation to each other and which each has a plurality of planar separating surfaces; said planar separating surfaces of said first and second nozzle parts each including a raised planar separating surface and a recessed planar separating surface with the raised planar separating surface being raised relative to the recessed planar separating surface; and said recessed planar separating surface of each said first and second nozzle parts supporting the raised planar separating surface of the opposed one of the first and second nozzle parts to define said liquid inlet passage, expansion chamber, exit orifice, and feedback passages.

* * * * *